United States Patent [19]

Buchy

[11] 4,122,642

[45] Oct. 31, 1978

[54] REFRACTORY LINER BLOCK

[75] Inventor: James P. Buchy, Waterdown, Canada

[73] Assignee: Plibrico (Canada) Limited, Burlington, Canada

[21] Appl. No.: 815,667

[22] Filed: Jul. 14, 1977

[51] Int. Cl.[2] ..... F23M 5/00

[52] U.S. Cl. ..... 52/511; 110/331; 110/336

[58] Field of Search ..... 52/511, 506, 253, 256, 52/258, 378, 712, 714, 443, 444, 700, 701, 249; 110/1 A, 1 B, 99 R, 99 A; 122/6 A; 263/46; 29/407, 157.4

[56] References Cited

U.S. PATENT DOCUMENTS

| | | | |
|---|---|---|---|
| 1,813,790 | 7/1931 | Wildish | 52/506 X |
| 2,021,610 | 11/1935 | Quint | 110/1 A X |
| 2,134,705 | 11/1938 | Crecca | 52/506 |
| 2,527,063 | 10/1950 | Heuer | 110/1 B |
| 2,553,393 | 5/1951 | Weber | 110/1 A X |
| 2,699,036 | 1/1955 | Nicholson | 110/1 A X |
| 2,854,842 | 10/1958 | Hosbein | 110/1 A |
| 3,330,546 | 7/1967 | Bryan | 110/1 A X |
| 3,376,681 | 4/1968 | Demaison | 110/1 A |
| 3,380,211 | 4/1968 | Snellman | 52/511 X |
| 3,687,093 | 8/1972 | Byrd, Jr. | 52/506 X |
| 3,747,291 | 7/1973 | Perigo | 52/506 |
| 3,762,123 | 10/1973 | Potocnik | 110/99 R |
| 3,771,467 | 11/1973 | Sweet | 52/506 X |
| 3,909,907 | 10/1975 | Davis | 110/1 A X |

FOREIGN PATENT DOCUMENTS

| | | | |
|---|---|---|---|
| 147,333 | 5/1949 | Sweden | 110/1 A |

*Primary Examiner*—Price C. Faw, Jr.
*Assistant Examiner*—Henry Raduazo
*Attorney, Agent, or Firm*—Fetherstonhaugh & Co.

[57] ABSTRACT

A lining block for lining the wall of a kiln furnace or the like according to one aspect of the present invention consists of a body of a refractory material having a passage extending from its inner face to its outer face and an anchor plate secured with respect to the refractory body and being accessible by way of said passage so that it may be secured with respect to the wall of the kiln or furnace to secure the lining block in position. A refractory lined chamber according to the present invention has a metallic wall and a plurality of lining blocks each having anchor plates welded to the metallic wall. The method of forming a refractory lining in the chamber having a metallic wall comprises the steps of; forming a plurality of lining blocks as described above and securing the anchor plates of the lining blocks with respect to the metallic wall by way of the through passage and filling the through passage with refractory material to form a continuous refractory lining chamber.

2 Claims, 6 Drawing Figures

REFRACTORY LINER BLOCK

FIELD OF THE INVENTION

This invention relates to a refractory lining block and a method of forming a refractory lining in a chamber of a kiln, furnace or the like.

PRIOR ART

The lining of a kiln or furnace with refractory material is an expensive and time consuming operation. Considerable difficulty has been experienced in attempting to secure the refractory lining with respect to the wall of the chamber which is to be lined.

In one method which is presently used, a plurality of anchor members are welded at spaced positions with respect to the wall of the chamber so as to project inwardly from the wall and thereafter refractory material is applied directly to the wall and permitted to cure to form a continuous lining with the anchoring members extending into the body of the lining and serving to secure the lining with respect to the wall of the chamber. This is a very costly process because the chamber must be out of production for some considerable time to enable the curing step to be completed. It also requires the exercise of considerable skill, care and attention on the part of the installation crew to ensure that a substantially uniform lining is applied to the walls of the chamber.

It has been previously proposed to overcome the difficulties of the method described above by preforming lining blocks and securing the lining blocks with respect to anchor posts previously welded to the wall of the chamber at spaced intervals about the wall of the chamber. In this process, however, considerable care must be taken to accurately locate the mounting posts with respect to the wall of the chamber to prevent a situation where a substantial gap may exist between adjacent blocks or where insufficient space may be provided between adjacent posts to permit the lining blocks to be located within the chamber in a side by side relationship. Thus, while the refractory blocks can be more easily manufactured in a precasting operation, the cost is merely transferred to the costs involved in locating the anchoring members with respect to the wall of the chamber.

The difficulties of the prior art described above are overcome by the precast refractory lining block of the present invention which is readily mountable at any position with respect to the wall of the chamber.

SUMMARY OF THE INVENTION

The precast refractory lining block of the present invention incorporates a metallic insert which is disposed within the body of refractory material so that it will be located closely adjacent the metallic wall of the chamber which is to be lined and which is accessible from the outer face of the block so as to be weldable to the metallic wall of the chamber to locate the block at any required position with respect to the chamber.

According to one aspect of the present invention, there is provided a lining block for lining the wall of a kiln, furnace or the like which comprises a body of refractory material having inner, outer and side faces and a passage extending from said inner face to said outer face, anchor plate means secured with respect to said refractory body and spaced inwardly from said outer face so as to be protected by the refractory body and being accessible by way of said passage so that it may be secured with respect to said wall.

According to a further aspect of the present invention a refractory lined chamber comprises a metallic wall having an inner face, a plurality of lining blocks each comprising a body of refractory material having inner, outer and side faces, a through passage extending from said inner face to said outer face, anchor plate means secured with respect to said refractory body and spaced inwardly from said outer face and being accessible from said outer face by way of said through passage during installation, said anchor plate means of each lining block being secured with respect to said metallic wall with said inner face disposed toward said metallic wall and said side faces disposed in an intimate face to face relationship, and refractory means disposed within said through passage of each block whereby said blocks form a continuous lining about the inner face of said metallic wall.

According to yet another aspect of the present invention, a method of forming a refractory lining in a chamber having a metallic wall comprises the steps of forming a plurality of lining blocks, each having inner, outer and side faces and a through passage extending from the inner face to the outer face and anchor plate means, said refractory material being cast about said anchor plate means to secure said anchor plate means with respect to the body of refractory material in a position spaced inwardly from the outer face of each lining block and exposed within said through passage, securing said anchor plate means with respect to said metallic wall by way of said through passage to secure said anchor blocks in a side by side position lining said chamber, and filling said through passages with refractory material to form a continuous refractory lining within said chamber.

The invention will be more clearly understood after reference to the following detailed specification read in conjunction with the drawings, wherein.

Figure 1:
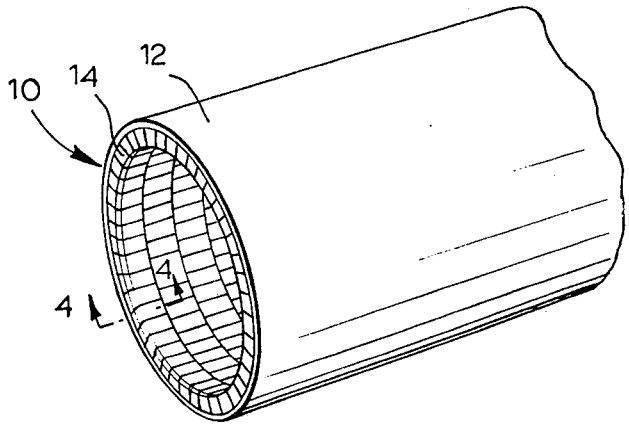
FIG. 1 is a pictorial view of a chamber of a kiln or furnace or the like according to an embodiment of the present invention.

With reference to the drawings, FIG. 1 illustrates a portion of a typical kiln or furnace 10 which consists of a metal wall 12 lined with a plurality of lining blocks 14 of refractory material. As shown in FIG. 1, the refractory blocks are located on the inner face of the chamber formed within the wall 12 in a side by side relationship in a series of circumferentially extending rows with adjacent rows being circumferentially displaced with respect to one another.

Figure 2:
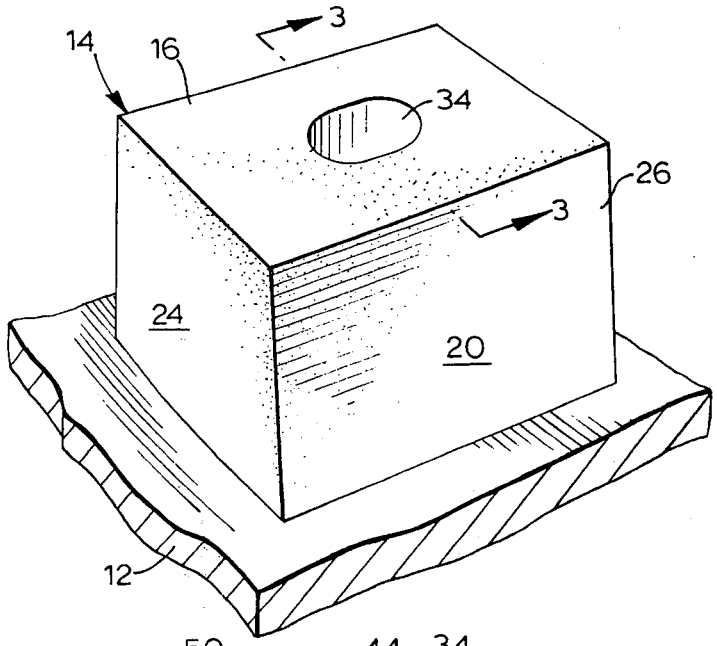
FIG. 2 is an enlarged view of a refractory block positioned on the wall of a chamber.
Figure 3:
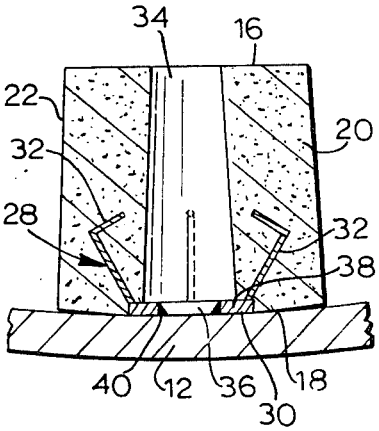
FIG. 3 is a sectional view of a block taken along the line 3—3 of FIG. 2.

The structure of one form of lining block 14 is more clearly illustrated in FIGS. 2 and 3 of the drawings. As shown in FIGS. 2 and 3, a lining block 14 is formed with an outer face 16, an inner face 18 and side faces 20, 22, 24 and 26. An anchor plate assembly 28 (FIG. 3) is cast into the body of refractory material and consists of an anchor plate 30 having a plurality of anchoring rios 32 projecting upwardly therefrom. The anchor plate 30 is located at the inner face 18 of the block and it will be noted that the inner face 18 is inclined outwardly away from the plane of the outer face of the anchor plate 30 to ensure that the anchor plate 30 may rest upon the wall 12 of the chamber. A passage 34 opens through the body of refractory material from the outer face 16 to the inner face 18. The passage tapers to a reduced cross-section in a direction towards the outer face 16 so as to anchor the refractory material which plug the passage as will be described hereinafter. A passage 36 opens through the anchor plate 30 and is aligned with the passage 34 of the refractory block. A marginal edge portion 38 of the anchor plate 30 projects inwardly from the sides of the passage 34. The refractory material may be of any refractory material such as PLICAST 40 (Trade Mark) reinforced with stainless steel needles.

The anchor plate 30 and arms 32 may be made from stainless steel with the arms 32 welded to the plate 30. The arms 32 have a finger portion at the other end thereof extending perpendicular to the main body portion so as to be firmly anchored within the body of refractory material. The passage 34 opens through the body of the refractory material and is proportioned to provide access to the anchor plate 30 from the outer face 16 so that a welding rod or the like may be extended through the passage 34 to weld the anchor plate 38 to the metal wall 12 as shown by the weld 40 (FIG. 3). The provision of the marginal edge portion 38 projecting inwardly from the side of the passage 34 facilitates the welding of the anchor plate 30 with respect to the wall 12.

After the refractory blocks have been secured to the wall chamber by welding as previously described, the passage 34 is plugged with plastic firebrick material or castable refractory material or the like. The tapered configuration of the passage 34 serves to lock the plug in position.

To manufacture a lining block of the type described above, an anchor assembly 28 of the type described above is positioned within a former designed to produce the required shape of block, including a through passage 34, and the former is filled with refractory material. The refractory block is removed from the former and is then oven cured by means of a kiln drying process so that the cured block has considerably greater strength and abrasion resistance than a conventional liner material which is cured in-situ. Thus not only does the prefabricated lining block provide a simplified method of lining a kiln or furnace, it also provides a lining which has improved structural characteristics.

To line a chamber of a kiln or furnace or the like, a first refractory block is positioned with the anchor plate 30 resting on the inner face of the metal wall 12 of the chamber. The anchor plate 30 is welded to the metal wall 12 by a welding rod which gains access to the interface between the anchor plate and the wall 12 by way of the passage 34. A plurality of additional lining blocks are located within the chamber and are welded in a side by side relationship in the manner described above to completely line the chamber or any required portion thereof.

Figure 4:
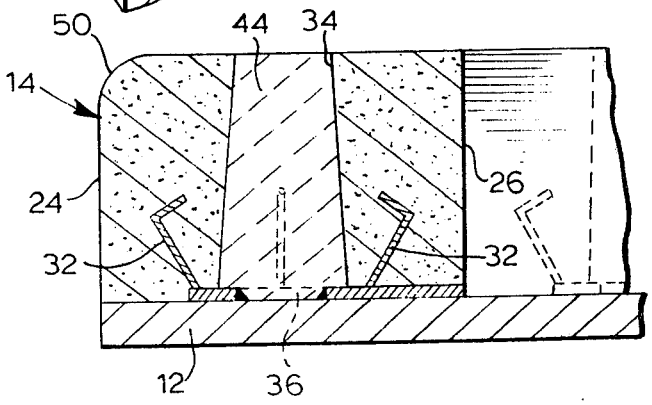
FIG. 4 is a sectional view taken along the line 4—4 of FIG. 1.

After each block has been welded in position or after all of the blocks have been welded in position, passages 34 are filled with a plastic firebrick material or castable refractory material as shown at 44 in FIG. 4. Thus, a continuous refractory lining may be formed in the chamber of a kiln or furnace or the like.

Refractory lining blocks constructed in accordance with the present invention are particularly useful for lining the areas of a furnace subjected to the greatest load, such as the nose ring of a rotary kiln and the area disposed inwardly from the tire support of the rotary kiln. The structure of the block illustrated in FIGS. 2 and 3 of the drawings is suitable for use at any position along the length of the chamber. In FIG. 4 of the drawings, the block 14 has a rounded edge 50 which serves to particularly adapt the block for use in the nose ring of a rotary kiln or the like.

Figure 5:
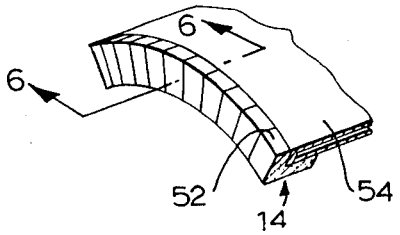
FIG. 5 is a partial view of the nose of a kiln lined with blocks constructed according to a further embodiment of the present invention.
Figure 6:
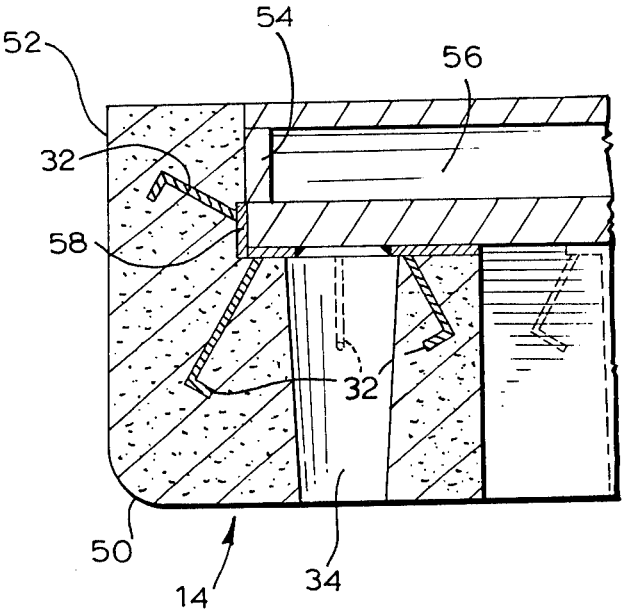
FIG. 6 is a sectional view along the line 6—6 of FIG. 5.

A block which is further adapted for use in the nose ring of a rotary kiln is illustrated in FIGS. 5 and 6 of the drawings wherein it will be seen that the block 14 has a radially outwardly extending portion 52 which extends over the end 54 of an air-cooled nose portion of a kiln. The passage 56 in the nose portion 54 is an air circulating passage which facilitates the cooling of the nose of the kiln. In the embodiment illustrated in FIGS. 5 and 6 of the drawings, the anchor includes a radial extension 58 which has arms 32 projecting outwardly therefrom into the body of the refractory material or the lining block to further secure the anchor plate with respect to the lining block.

From the foregoing, it will be apparent that if any one of the lining blocks is damaged or excessively worn as a result of use, it can be replaced without the necessity of replacing the entire lining of the chamber. In particular, it will be noted that the blocks which are located at the nose ring may be removed and replaced without replacing all of the remaining blocks of the lining.

Various modifications of the present invention may be apparent to those skilled in the art without departing from the scope of the invention disclosed.

For example, while the ability to weld the anchor member of the present invention to the wall of the furnace is considered to be of great practical advantage, the lining block could be secured to the wall by anchor bolts or the like, in which case the through passage of the anchor plate would be proportioned to provide an interference fit for the heat of an anchor bolt or an anchoring nut or the like. In a further modification, the anchor means may be in the form of a tubular sleeve or the like forming a portion of the side wall of the through passage 34. It will also be apparent that the through passage 34 need not extend through the center of the block. The through passage may be in the form of an arcuate recess in one or more of the sides of the block and it may be positioned to be aligned with a corresponding recess in an adjacent block to provide a passage permitting access to the interface between the anchor member and the wall of the chamber to permit welding. These and other modifications of the preferred embodiment will be apparent to those skilled in the art.

The embodiments of the invention in which an exclusive property or privilege is claimed are defined as follows:

1. A lining block for lining the wall of a kiln of a furnace or the like comprising:

(a) a body of refractory material having an inner face, an outer face and a plurality of side faces, the side faces being adapted to be located in a face-to-face relationship with the side faces of the second block to form a composite lining, a passage extending through the refractory body and having an inner end located at the inner face and an outer end located at the outer face of the body, a recess in the inner face extending laterally from the inner end of said passage, (b) an anchor plate having an inner surface, an outer surface and an opening extending therethrough from the inner surface to the outer surface, said anchor plate being mounted in said recess with said opening aligned with said passage and said inner surface bearing against an inner wall of the recess, a portion of said anchor plate projecting laterally into said passage and having its outer surface supported in the plane of said inner face of said lining block by engagement of said inner surface with the inner wall of said recess and anchor rib means mounted on said anchor plate and projecting from said anchor plate into said body to secure said anchor plate within said recess, said opening in said anchor plate being aligned with said passage of said block to provide welding access to said portion of said anchor plate.

2. A lining block as claimed in claim 1, wherein said passage is tapered to a reduced cross-sectional area in a direction towards said outer face.

* * * * *